United States Patent [19]

Luebrecht et al.

[11] Patent Number: 4,499,971

[45] Date of Patent: Feb. 19, 1985

[54] MATERIAL HANDLING VEHICLE HAVING IMPROVED CHAIN MONITORING

[75] Inventors: Donald Luebrecht, Fort Jennings; Kim A. Klopfleisch, St. Marys, both of Ohio

[73] Assignee: Crown Controls Corporation, New Bremen, Ohio

[21] Appl. No.: 487,533

[22] Filed: Apr. 22, 1983

[51] Int. Cl.[3] ..... B66B 9/20

[52] U.S. Cl. ..... 187/9 R; 187/81; 182/19; 182/63; 182/148; 254/273; 414/665; 414/674

[58] Field of Search ..... 187/9 E, 9 R, 28, 80, 187/81; 182/19, 63, 141, 148; 254/273; 340/668, 685; 414/665, 674

[56] References Cited

U.S. PATENT DOCUMENTS

| | | | |
|---|---|---|---|
| Re. 24,958 | 3/1961 | Ehmann | 414/635 |
| 3,012,520 | 12/1961 | Curtis | 254/273 X |
| 3,096,896 | 7/1963 | Norton et al. | 414/670 |
| 3,202,242 | 8/1965 | Dolphin | 187/9 E |
| 3,241,697 | 3/1966 | Rogant | 414/666 |
| 3,416,109 | 12/1968 | Gandolfo et al. | 182/148 X |
| 3,612,221 | 10/1971 | Branham | 187/81 X |
| 3,937,346 | 2/1976 | van der Laan | 187/9 E X |
| 3,998,345 | 12/1976 | Fiehler et al. | 414/641 |
| 4,236,862 | 12/1980 | McCormick | 414/633 |
| 4,252,491 | 2/1981 | Hock | 187/9 R X |
| 4,305,513 | 12/1981 | Voelz | 254/273 X |
| 4,366,883 | 1/1983 | Reeves | 187/9 R |

FOREIGN PATENT DOCUMENTS

| | | | |
|---|---|---|---|
| 1455254 | 11/1978 | United Kingdom | 187/81 |
| 0630201 | 9/1978 | U.S.S.R. | 254/273 |

*Primary Examiner*—Joseph J. Rolla
*Assistant Examiner*—Lawrence J. Miller
*Attorney, Agent, or Firm*—Biebel, French & Nauman

[57] ABSTRACT

An improved system for monitoring lift chains included within mast assemblies in material handling vehicles disables downward movement of the forks upon detection of a first level of slackness in a lift chain. Since upward movement of the forks is not disabled, the forks may be raised to clear any obstruction causing the chain slackness. A lift chain may also be monitored to detect a broken chain in which case all vertical movement of the forks is disabled. In a material handling vehicle wherein the operator is elevated along a first mast and the forks are elevated along a second mast connected to an operator's platform, dual lift chains in the first mast are individually monitored for both slackness and breakage while dual lift chains in the second mast are monitored in common primarily to detect slackness. Lateral and rotational movement of the forks is also disabled for detection of a slack or broken first mast lift chain, but not for detection of a slack or broken second mast lift chain.

16 Claims, 6 Drawing Figures

MATERIAL HANDLING VEHICLE HAVING IMPROVED CHAIN MONITORING

BACKGROUND OF THE INVENTION

This invention relates generally to material handling vehicles and, more particularly, to an improved system for monitoring lift chains within such vehicles.

The high cost of warehouse space makes it economically desirable to provide high racks for storing materials within a warehouse. Due to the vertical extension of storage in warehouses, a variety of material handling vehicles have been developed wherein material handling devices, typically forks, are elevated to extreme heights to store and retrieve materials at the upper levels within the warehouse.

Such high lift vehicles commonly use a variety of mast arrangements wherein the forks and oftentimes even the operator of the vehicle are lifted high above the floor of the warehouse to perform these storage operations. While the masts and forks are normally controlled by means of hydraulic systems which can exert the necessary forces required to move the heavy machines and materials, it is the case in many designs that the masts have chains for transmitting the hydraulic power to the masts and/or forks for vertical movement. Typically, one or often two chains are provided which chains are normally taut during operation of the material handling vehicle.

In two chain or duplicated chain systems, it is known to monitor the chains so that if one of the chains breaks, the material handling vehicle can be stopped and repaired prior to further operation. However, a broken chain is sensed by the detection of slackness in the chain. Hence, if the forks or a portion of an elevated platform hangup or catch on a rack or other obstruction as they are being lowered, slackness may develop in the chains and this slackness may be sensed as a broken chain resulting in the vehicle being disabled until it can be serviced. Such unwarranted interruption of the operation of a material handling vehicle can be costly.

Thus, it is apparent that the need exists for an improved chain monitoring system for use on material handling vehicles which are utilized to handle heavy materials oftentimes at high elevations in warehouse storage racks.

SUMMARY OF THE INVENTION

In accordance with the present invention, elevation control or lift chains typically included within mast assemblies in material handling vehicles are monitored by an improved system which disables downward movement of the forks or other material handling or manipulating apparatus upon detection of a first level of slackness in a lift chain. Since the ability to move the forks or material handling apparatus of the vehicle in an upward direction is not inhibited by the detection of a first level of slackness in a lift chain, an operator is free to raise the forks or material handling portion of the vehicle to clear whatever obstruction has caused the detected chain slackness.

Preferably, the improved chain monitoring system in accordance with the present invention further comprises second chain monitoring means which are coupled to the lift chain for detecting a second level of slackness exceeding the first level of slackness which indicates that the chain has broken. In the event that the second monitoring means indicates a broken chain, all movement or at least all vertical movement of the material handling apparatus or forks is inhibited until the material handling vehicle can be serviced.

The present invention is particularly applicable to material handling vehicles wherein duplicated lift or elevation control chains are provided. In duplicated chain applications, a pair of monitors are provided for each chain such that both a slack chain condition and a broken chain condition can be sensed for either chain. In this case, if either chain is detected as being slack, all but upward vertical movement of the material handling apparatus or forks is inhibited; accordingly, the operator is able to raise the material handling apparatus or forks to clear them from an obstruction that has caused one or both of the chains to go slack.

On the other hand, if either of the chains is sensed as being broken, the material handling apparatus or forks will be supported by the remaining chain and yet all movement of the material handling apparatus or forks is inhibited so that the material handling vehicle must be serviced prior to further operation.

The present invention can be extended to material handling vehicles including dual mast assemblies which vehicles are typically utilized for narrow aisle access in high elevation warehouse storage. In these material handling vehicles, oftentimes the operator sits in a platform which is elevated along a first or primary mast assembly and the material handling apparatus or forks are additionally elevated along an auxiliary mast assembly which is connected to the platform. The elevation of the operator is beneficial since this places the operator in a better position to view and control the placement and removal of materials at the higher levels of the storage racks within a warehouse.

While duplicated chains are typically provided in both the primary mast assembly and the auxiliary mast assembly, it is less important that a broken chain in the auxiliary mast assembly cause rapid disabling of all vertical movement of the material handling apparatus or forks since personnel are not supported by the auxiliary mast assembly. Accordingly, a single monitor is provided for the chain or chains within the auxiliary mast assembly primarily to detect chain slackness indicating typically that the forks or the material handling apparatus have hungup on some obstruction while being lowered. The single monitor will detect a broken chain in a single chain auxiliary mast, but will not detect a single broken chain in a two chain mast.

In accordance with the present invention, an indication of a slack auxiliary mast chain or chains disables downward vertical movement of the material handling apparatus by means of either the primary mast assembly or the secondary mast assembly. Accordingly, for detected auxiliary mast chain slackness, the operator can still elevate the forks or material handling apparatus to clear them from an obstruction and permit continued operation of the material handling vehicle provided, of course, that a total failure of the auxiliary mast chain or chains has not occurred.

In accordance with one aspect of the present invention, chain monitoring means comprise electrical switches having activating lever arms which are resiliently biased against the lift chains. Where both slack and broken chains are to be detected, a lever arm is provided to activate the two switches at the two differing degrees of slackness with the lever arm being resiliently biased against the chains with sufficient force that the lever arm will be deflected to activate the broken chain switch in substantially the same amount of time as it takes to deflect the lever arm to activate the slack chain switch.

It is, therefore, an object of the present invention to provide an improved lift chain monitoring system for a material handling vehicle which can detect slackness in a lift chain and prevent downward movement of the apparatus handling portion or forks of the vehicle in response to detected chain slackness while permitting upward movement such that the apparatus handling portion or forks of the vehicle can be elevated to clear them from whatever obstruction has caused the detected slackness in the lift chain.

Other objects and advantages of the invention will be apparent from the following description, the accompanying drawings and the appended claims.

DETAILED DESCRIPTION OF THE INVENTION

Figure 1:
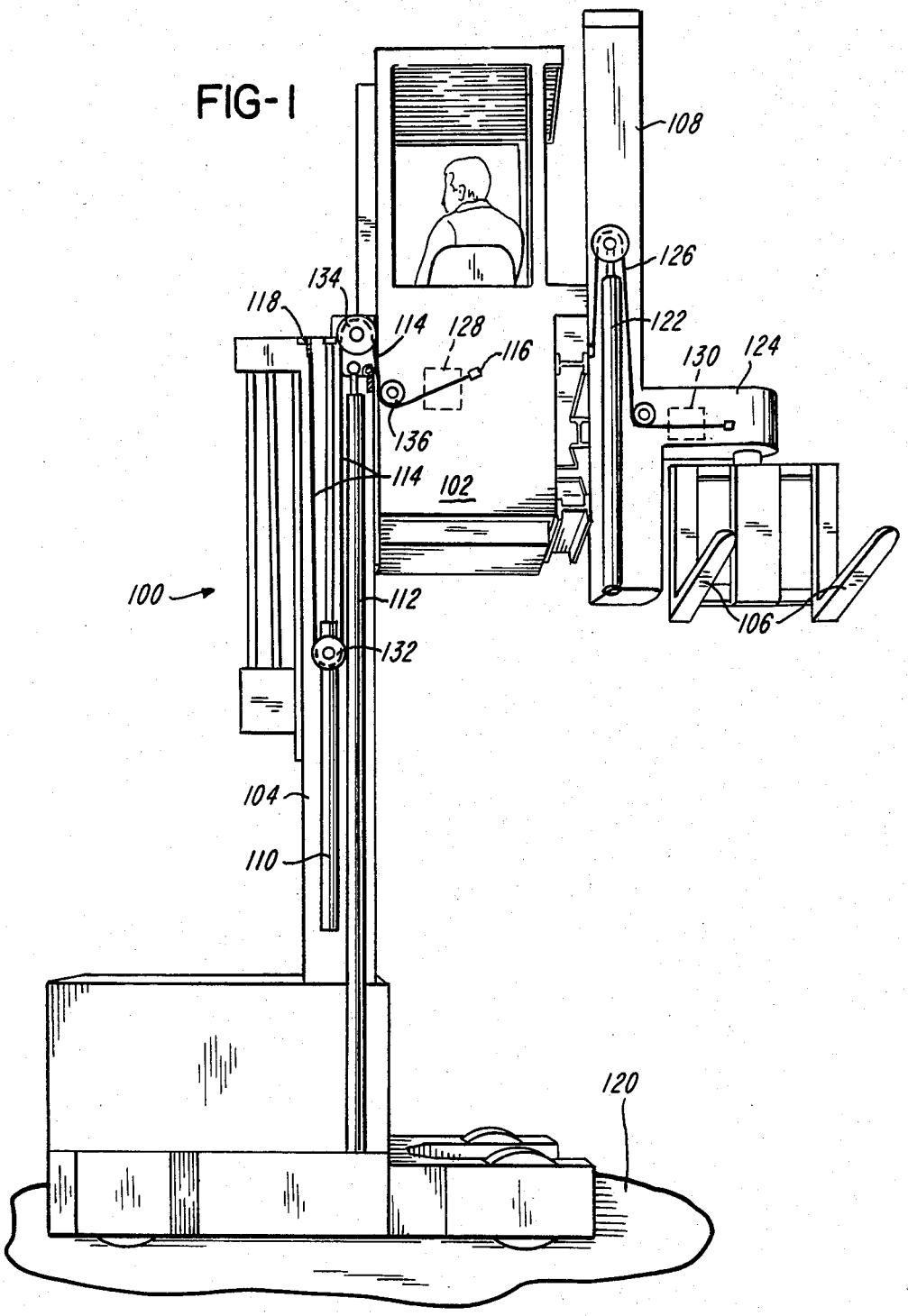
FIG. 1 is partially sectioned schematic view of a material handling vehicle including primary and auxiliary mast assemblies in which the lift or elevation control chains are monitored by the improved system in accordance with the present invention.

In FIG. 1, a material handling vehicle 100 comprises a platform 102 which is elevated along a first or primary mast assembly 104 and material handling apparatus or forks 106 are elevated along a second auxiliary mast assembly 108 which is connected to the platform 102.

Elevation of the platform 102 along the primary mast assembly 104 is controlled by first motor means, hydraulic cylinders 110 and 112 in the embodiment illustrated in FIG. 1. The platform 102 is initially elevated along a portion of the primary mast assembly 104 through elevation control or lift chains 114 which are secured at one end 116 to the platform 102 and at the other end 118 to the upper portion of the mast assembly 104.

By activation of the hydraulic cylinder 110, the chains 114 are effectively shortened to raise the platform 102 along a portion of the mast 104 as is well known in the art. Once the platform 102 is elevated to a desired height along the mast 104 (full elevation is shown in FIG. 1), the hydraulic cylinder 112 is activated to extend the mast 104 and further elevate the platform 102 above the floor 120 of the warehouse.

The auxiliary mast assembly 108 includes second motor means comprising a second hydraulic cylinder 122 which elevates a fork control turret 124 from which the forks 106 are pivotally suspended. Activation of the hydraulic cylinder 122 engages an auxiliary mast chain 126 to elevate the turret 124 and in turn the forks 106 as is well known in the art.

Figure 2:
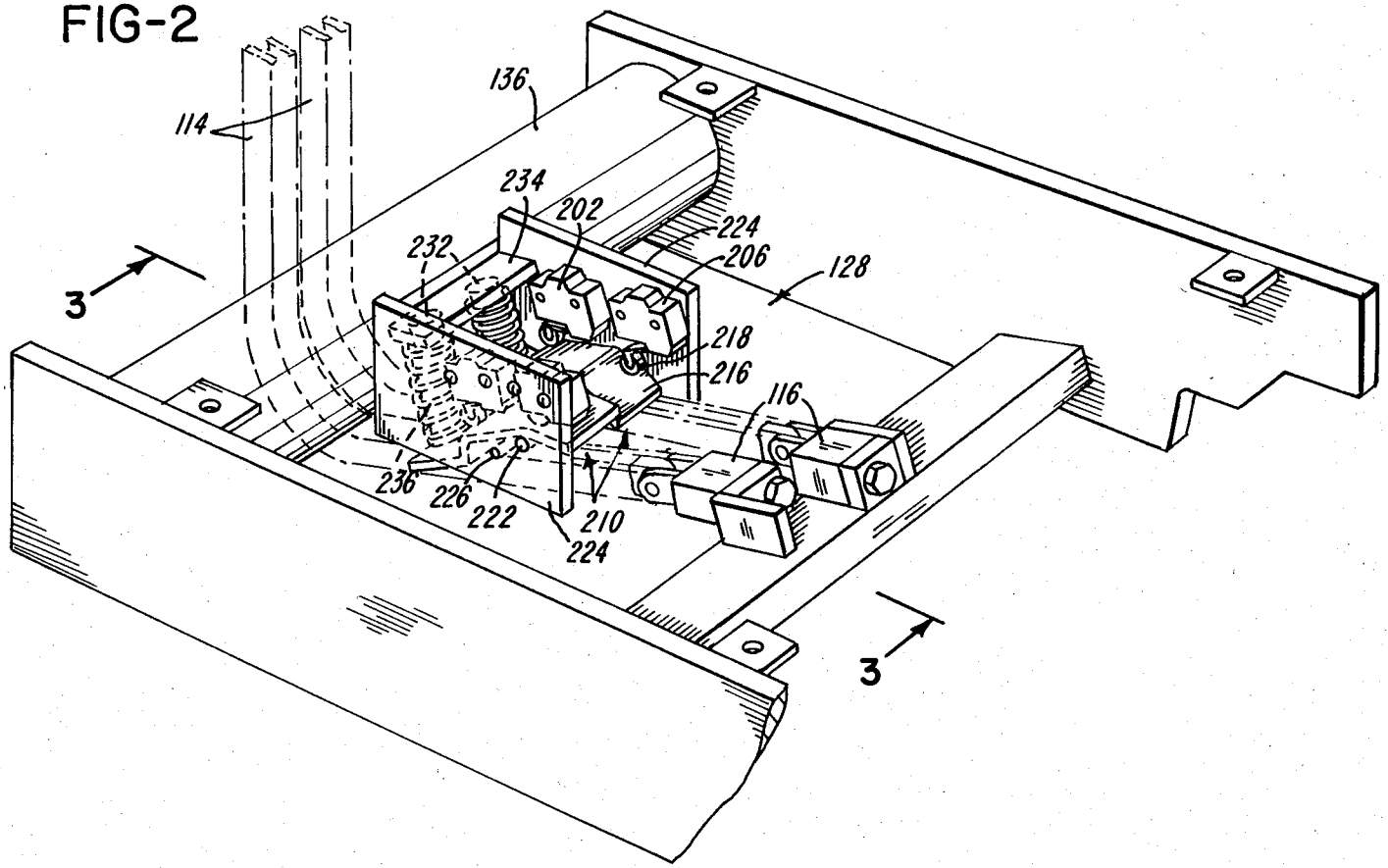
FIG. 2 is a perspective view of an illustrative arrangement for monitoring duplicated lift or elevation control chains in the primary mast assembly of FIG. 1.
Figure 3:
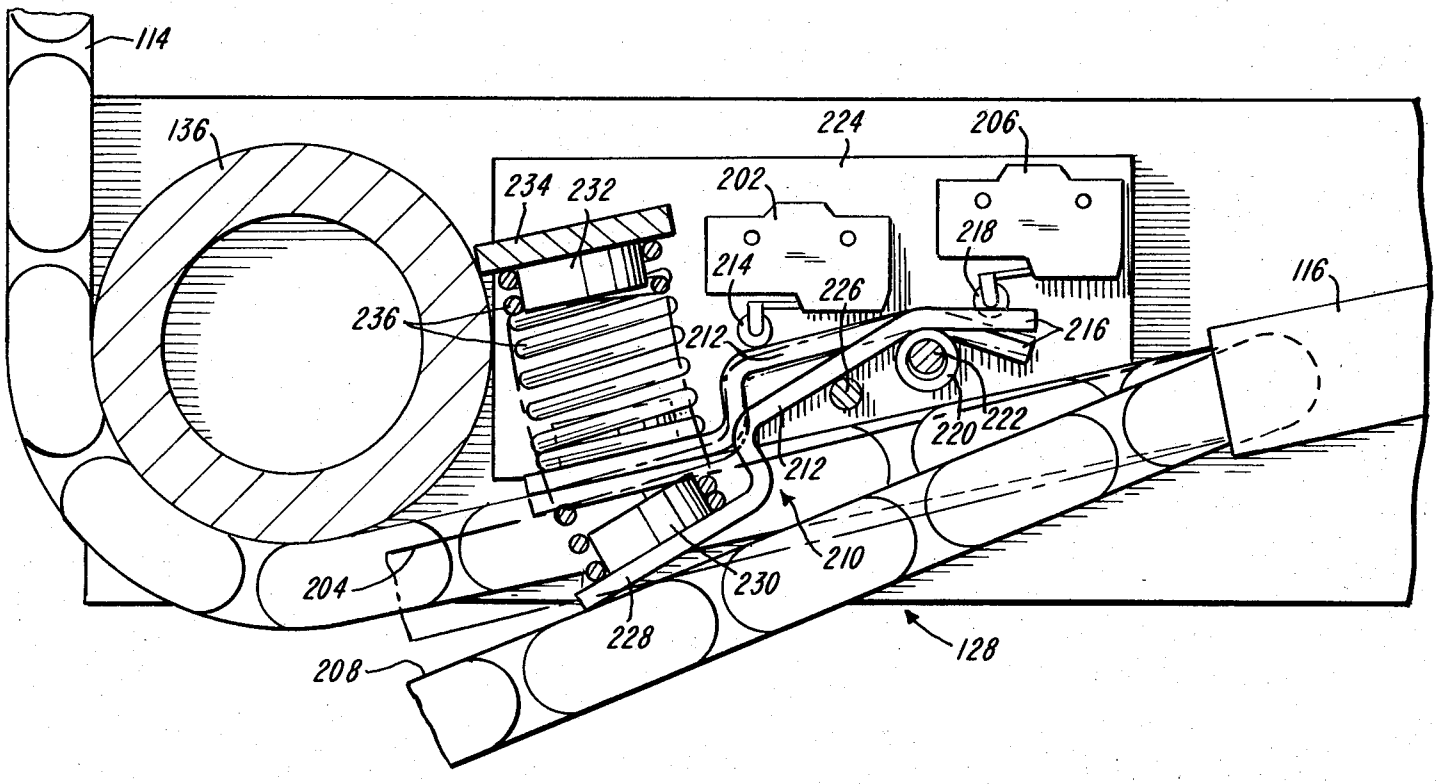
FIG. 3 is a sectional view of the monitoring arrangement of FIG. 2 taken along the line 3—3.
Figure 4:
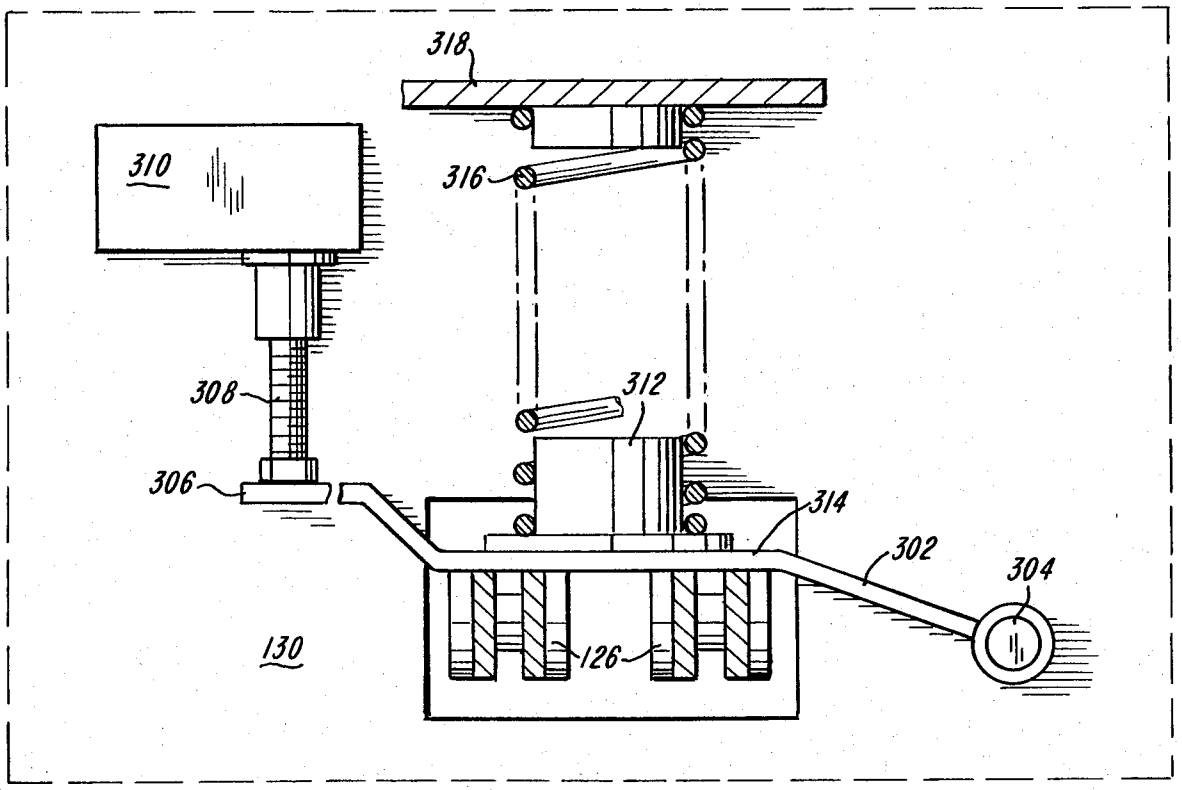
FIG. 4 is a detailed side view of an illustrative arrangement for monitoring the lift or elevation control chains of the auxiliary mast assembly of FIG. 1.

The improved chain monitoring system in accordance with the present invention includes primary mast chain monitoring switches 128, shown in detail in FIGS. 2 and 3, and an auxiliary mast chain monitoring switch 130, shown in detail in FIG. 4. It is noted that the elevation control or lift chains 114 and 126 and the associated motor means and mechanical apparatus required for their operation are shown only schematically in FIG. 1 since a large variety of such systems are known. For example, the hydraulic cylinder 110 may be duplicated with chain pulleys 132 suspended between the duplicated cylinders. Alternatively, chain pulleys 134 could be connected to the upper portion of the mast assembly 104 and a single hydraulic cylinder could be utilized to elevate the mast assembly 104 and thereby simultaneously elevate the platform 102 and the elevatable portion of the mast assembly 104 such that they both reach maximum height at approximately the same time. Such arrangements, as well as many others, are well known in the art and will not be described further herein.

FIGS. 2 and 3 show an illustrative embodiment of a mounting arrangement for the chain monitoring switches 128 which monitor the elevation control or lift chains 114 of the primary mast assembly 104. The chains 114 extend around a cylindrical member 136 and are secured to the platform 102 at the chain ends 116. Electrical switches 202 comprise first chain monitoring means which are coupled to the elevation control or lift chains 114 for generating a slack chain signal in response to a first level of slackness in the associated chain. Such a slack chain is indicated by the upper surface of the chain going to a position indicated approximately by a lever arm shown in phantom in FIG. 3.

Electrical switches 206 comprise second chain monitoring means which are coupled to the elevation control or lift chains 114 for generating a broken chain signal upon detection of a second level of slackness in the associated chain which exceeds the first level of slackness. A broken chain is indicated approximately by the upper surface of one of the chains 114 going to a position indicated by the lower of the two lever arms shown in solid line in FIG. 3.

In the illustrated embodiment of the chain monitoring switches 128 shown in FIGS. 2 and 3, lever arms are provided for coupling the electrical switches 202 and 206 to their associated elevation control or lift chains 114. The lever means comprise angularly formed lever arms 210. Each of the lever arms 210 comprises a generally flat portion 212 which engages a switch activating roller 214 of the switches 202. An angularly oriented portion 216 extends downwardly from the generally flat portion 212 and activates the switches 206 through roller activators 218 of the switches 206.

A generally cylindrical member 220 is secured to each lever arm 210 at the point where the generally flat portion 212 joins with the downwardly extending angularly oriented portion 216. The generally cylindrical member 220 is mounted for rotation over a generally cylindrical shaft 222 which extends between switch mounting plates 224. Downward motion of the lever arms 210 is restricted by a second generally cylindrical shaft 226 which also extends between the switch mounting plates 224 to prevent the lever arms 210 from possibly damaging the associated switch 206 in the event that a chain being monitored breaks and permits its associated lever arm to be fully deflected.

Each of the lever arms 210 further comprises a downwardly offset extension 228 which includes a cylindrical member 230 secured to its upper surface. A similar cylindrical member 232 is mounted to a spring support plate 234 which extends between the switch mounting plates 224. The cylindrical members 232 engage resilient means comprising springs 236 which bias the lever arms 210 into engagement with their associated one of the lift chains 114. Thus, the pin 226 also prevents the springs 236 from becoming disengaged from the cylindrical members 230 and 232 upon the occurrence of a chain break.

Each of the springs 236 is of sufficient resiliency that its associated lever arm 210 is rapidly deflected upon a chain break. Accordingly, its associated switch 206 is activated at substantially the same time as its associated switch 202 is activated. This illustrative embodiment of the chain monitoring switches 128 provides for the generation of both a slack chain signal and a broken chain signal for operation of the improved monitoring system in accordance with the present invention.

The detection of a single broken chain is less important in the auxiliary mast assembly 108 since the auxiliary mast assembly is not utilized to support personnel. Hence, the dual auxiliary mast lift chains 126 are monitored by a single switch which detects a slack auxiliary chain condition if both of the duplicated auxiliary mast lift chains 126 go slack.

As shown in FIG. 4, a lever arm 302 is pivotally mounted about a pin 304 and positioned to ride on the upper surface of the auxiliary mast lift chains 126. The distal end 306 of the lever arm 302 is positioned to engage an activating extension 308 of an auxiliary chain monitoring switch 310. In the event that both of the auxiliary mast lift chains 126 go slack or are broken, the switch 310 is operated. A generally cylindrical member 312 is positioned opposite the auxiliary chains 126 on the upper surface of a generally horizontal portion 314 of the lever arm 302. The cylindrical member 312 receives a spring 316 which is mounted in compression between a spring retaining plate 318 and the lever arm 302. The resiliency of the spring 316 ensures a rapid response of the switch 310 to slack conditions of both auxiliary mast lift chains 126.

Figure 5:
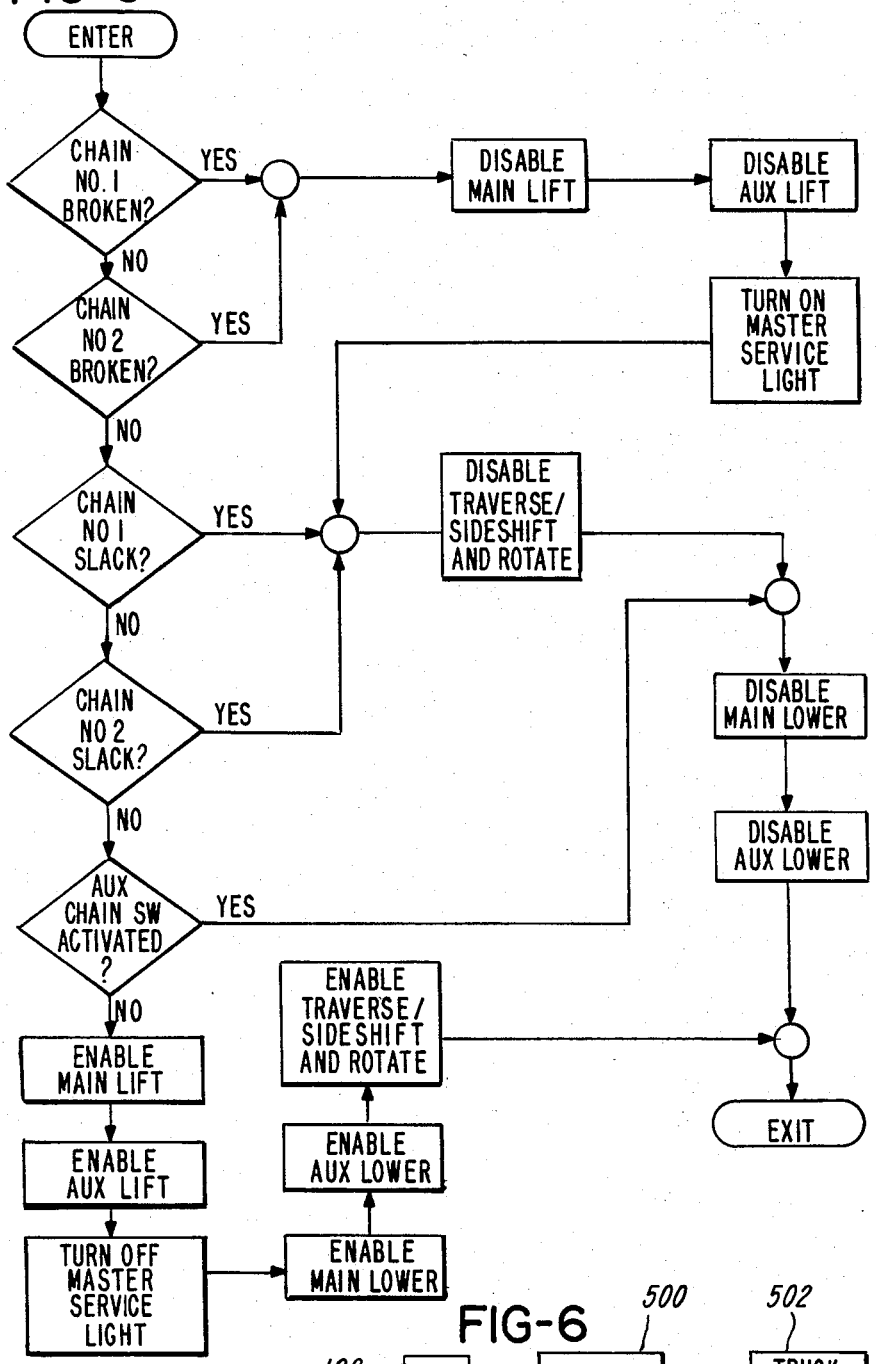
FIG. 5 is a flow chart illustrating the control functions performed by the improved chain monitoring system in accordance with the present invention.
Figure 6:
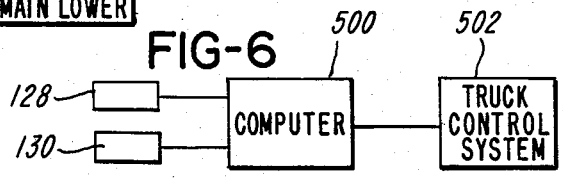
FIG. 6 is a block diagram of a computerized implementation of the improved chain monitoring system in accordance with the present invention.

FIG. 5 is a flow chart for a computer implementation of the improved chain monitoring system in accordance with the present invention as shown in FIG. 6. In FIG. 6, contacts of the primary mast chain monitoring switches 128 (202 and 206) and the auxiliary mast chain monitoring switch 130 (310) are monitored by a computer 500 which is programmed to perform the operations indicated in the flow chart of FIG. 5. The computer 500 in accordance with the flow chart of FIG. 5 generates enable and disable signals which are passed to a truck control system 502.

The truck control system 502 can be any of a variety of systems for controlling a truck or material handling vehicle of the variety disclosed herein having both a primary mast assembly for elevating an operator platform and an auxiliary mast assembly connected to the operator platform for further elevation of material handling apparatus, typically forks. A typical truck control system is shown in pending application Ser. No. 487,626, entitled Improved Method and Apparatus for Side Shift Carriage Control, which was concurrently filed herewith by Donald Luebrecht and Nicholas D. Thobe.

Operation of the improved chain monitoring system in accordance with the present invention will now be described. The computer 500 may be programmed by anyone having ordinary skill in the art to perform the functions outlined in the flow chart of FIG. 5 and as described herein. Initially, signals from the switches 206, contacts of which are normally held closed and are opened to indicate a broken chain condition, are examined. If either of the switches 206 indicates that its associated primary mast lift chain (one of the chains 114) is broken, then the main mast lift and the auxiliary mast lift are disabled and a master service light (not shown) is turned on. Also auxiliary movement of the forks (both rotation upon the fork control turret 124 as well as lateral movement to extend or retract the forks from a storage rack) are disabled. Lateral movement of the forks by means of traversing the auxiliary mast assembly 108 across a sideshift carriage and also movement of the sideshift carriage (traverse/sideshift) is known in the art and disclosed, for example, in U.S. Pat. No. 3,998,346. Finally the main or primary mast assembly lower is disabled and the auxiliary mast assembly lower is disabled.

In the event that neither of the chains 114 is indicated as being broken, the slack chain switches 202 are examined to see if normally closed contacts of either switch have been opened indicating that a slack chain condition exists in the corresponding chain. In the event that one or both of the chains 114 is indicated as being slack, the traverse/sideshift and rotate functions of the forks 106 are disabled and the main or primary mast assembly lower and the auxiliary mast assembly lower are disabled. If only slackness of one or both of the main mast chains is detected, the main or primary mast assembly lift and auxiliary mast assembly lift are still enabled such that the forks 106 can be raised to free them from whatever obstruction has caused the detected slackness in one or both of the main mast assembly lift chains 114.

In the event that neither of the primary mast assembly lift chains 114 is indicated as being broken or slack, the auxiliary mast chain monitoring switch 310 is interrogated to determine whether normally closed contacts of the switch 310 have been opened. Such opened contacts of the switch 310 indicate that the chains 126 of the auxiliary mast are slack or broken. If the auxiliary chains 126 are indicated as being slack or broken, the main mast assembly lower and the auxiliary mast assembly lower are disabled.

In the event that neither of the primary mast assembly lift chains 114 was indicated as being broken or slack and the auxiliary mast assembly lift chains 126 are similarly not indicated as being slack or broken, then the main mast assembly lift and auxiliary mast assembly lift are enabled, the master service light is turned off, the main mast assembly lower and auxiliary mast assembly lower are enabled and the traverse/sideshift and rotate functions of the forks 106 are enabled.

Accordingly, a material handling vehicle incorporating the improved chain monitoring system of the present invention is capable of detecting slack chain conditions in either the primary mast assembly or the auxiliary mast assembly. Upon detection of a slack lift chain, lowering operations and possibly all auxiliary movement, i.e., traverse/sideshift and rotate, of the forks are disabled while the primary mast assembly and auxiliary mast assembly lift operations remain enabled such that the forks can be raised to free them from any obstruction which caused the detected slackness. Further, the system disables main and auxiliary mast lift operations as well as advising the operator that a service call is required in the event that a broken primary mast lift chain is detected.

While the form of apparatus herein described constitutes a preferred embodiment of this invention, it is to be understood that the invention is not limited to this precise form of apparatus and that changes may be made therein without departing from the scope of the invention which is defined in the appended claims.

What is claimed is:

1. In a material handling vehicle having a first mast assembly, material handling means suspended from and guided for vertical movement by said first mast assembly, first motor means, and at least a first chain, said first motor means and said first chain being coupled to said first mast assembly and said material handling means to effect vertical movement of said material handling means in response to movement of said first motor means, an improved chain monitoring system comprising:

first monitoring means coupled to said first chain for generating a slack chain signal in response to a first level of slackness in said first chain; and control means responsive to said slack chain signal for disabling downward vertical movement of said material handling means, upward verticle movement of said material handling means remaining enabled such that said material handling means can be raised to clear whatever obstruction caused the detected slackness in said first chain.

2. An improved chain monitoring system as claimed in claim 1 wherein said material handling means is capable of axiliary movement and said control means further disables all auxiliary movement of said material handling means in response to said slack chain signal.

3. An improved chain monitoring system as claimed in claim 1 wherein said material handling means is capable of auxiliary movement and further comprising second monitoring means coupled to said first chain for generating a broken chain signal upon detection of a second level of slackness in said first chain exceeding said first level of slackness, said control means being further responsive to said broken chain signal for disabling all vertical movement of said material handling means.

4. An improved chain monitoring system as claimed in claim 3 wherein said control means further disables all auxiliary movement of said material handling means in response to said slack chain signal or said broken chain signal.

5. An improved chain monitoring system as claimed in claim 3 wherein said material handling vehicle further comprises a second chain, said first motor means and said first and second chains being coupled to said first mast assembly and said material handling means to effect vertical movement of said material handling means in response to movement of said first motor means, said improved chain monitoring system further comprising:

first monitoring means coupled to said second chain for generating a slack chain signal upon detection of a first level of slackness in said second chain; and second monitoring means coupled to said second chain for generating a broken chain signal upon detection of a second level of slackness in said second chain exceeding said first level of slackness, said control means being responsive to said slack chain signal from either of said first monitoring means for disabling downward vertical movement of said material handling means and being further responsive to said broken chain signal from either of said second monitoring means for disabling all vertical movement of said material handling means.

6. An improved chain monitoring system as claimed in claim 5 wherein said control means further disables all auxiliary movement of said material handling means in response to said slack chain signal from either of said first monitoring means or said broken chain signal from either of said second monitoring means.

7. An improved chain monitoring system as claimed in claim 5 wherein said material handling means comprises a platform, an auxiliary mast assembly connected thereto, material handling apparatus suspended from and guided for vertical movement by said auxiliary mast assembly, second motor means, and at least a first auxiliary mast chain, said second motor means and said first auxiliary mast chain being coupled to said auxiliary mast assembly and said material handling apparatus to effect vertical movement of said material handling apparatus in response to movement of said second motor means, said improved chain monitoring system further comprising auxiliary chain monitoring means coupled to said auxiliary mast chain for generating a slack auxiliary mast chain signal upon detection of slackness in said auxiliary mast chain, said control means being further responsive to said slack auxiliary mast chain signal for disabling downward vertical movement of said platform and said material handling apparatus.

8. In a material handling vehicle having a first mast assembly, material handling means suspended from and guided for vertical movement by said first mast assembly, first motor means, and at least a first chain, said first motor means and said first chain being coupled to said first mast assembly and said material handling means to effect vertical movement of said material handling means in response to movement of said first motor means, an improved chain monitoring system comprising:

first monitoring means for generating a slack chain signal;

first lever means coupling said first monitoring means to said first chain such that said first monitoring means is activated to generate a slack chain signal upon detection of a first level of slackness in said first chain; and control means responsive to said slack chain signal for disabling downward vertical movement of said material handling means, upward vertical movement of said material handling means remaining enabled such that said material handling means can be raised to clear whatever obstruction caused the detected slackness in said first chain.

9. An improved chain monitoring system as claimed in claim 8 further comprising second monitoring means for generating a broken chain signal, said first lever means coupling said second monitoring means to said first chain such that said second monitoring means is activated to generate a broken chain signal upon detection of a second level of slackness in said first chain exceeding said first level of slackness, said control means being further responsive to said broken chain signal for disabling all vertical movement of said material handling means.

10. An improved chain monitoring system as claimed in claim 9 wherein said material handling vehicle includes first and second chains, said first motor means and said first and second chains being coupled to said first mast assembly and said material handling means to effect vertical movement of said material handling means in response to movement of said first motor means, said improved chain monitoring system further comprising duplicated first and second monitoring means to monitor said first and second chains and said control means is responsive to said slack chain signal from either of the duplicated first monitoring means for disabling downward vertical movement of said material handling means and is further responsive to said broken chain signal from either of the duplicated second monitoring means for disabling all vertical movement of said material handling means.

11. An improved chain monitoring system as claimed in claim 10 wherein said material handling means is capable of axiliary movement and said control means further disables auxiliary movement of said material handling means in response to said slack chain signal from either of said first monitoring means or said broken chain signal from either of said second monitoring means.

12. An improved chain monitoring system as claimed in claim 11 wherein said material handling means comprises a platform, an auxiliary mast assembly connected thereto, material handling apparatus suspended from and guided for vertical movement by said auxiliary mast assembly, second motor means, and at least a first auxiliary mast chain, said second motor means and said first auxiliary mast chain being coupled to said auxiliary mast assembly and said material handling apparatus to effect vertical movement of said material handling apparatus in response to movement of said second motor means, said improved chain monitoring system further comprising:

auxiliary chain monitoring means for generating a slack auxiliary mast chain signal;

second lever means coupling said auxiliary chain monitoring means to said auxiliary mast chain such that said auxiliary chain monitoring means is activated to generate a slack auxiliary mast chain signal upon detection of slackness in said auxiliary mast chain; and said control means being further responsive to said slack auxiliary mast chain signal for disabling downward movement of said platform and said material handling apparatus.

13. An improved chain monitoring system as claimed in claim 12 further comprising first resilient means for biasing said first lever means into said first and second chains, said first resilient means having sufficient force to rapidly deflect said first lever means such that said second monitoring means is activated upon a chain break at substantially the same time as said first monitoring means.

14. An improved chain monitoring system as claimed in claim 13 further comprising second resilient means for biasing said second lever means into said auxiliary mast chain such that said second lever means is rapidly deflected upon slackness in said auxiliary mast chain to activate said auxiliary chain monitoring means.

15. An improved chain monitoring system as claimed in claim 14 wherein said first and second chain monitoring means comprise electrical switches.

16. An improved chain monitoring system as claimed in claim 15 wherein said first and second motor means each comprise at least one hydraulic cylinder.

* * * * *